United States Patent [19]

Euler

[11] Patent Number: 4,585,325

[45] Date of Patent: Apr. 29, 1986

[54] FIXING ROLLER DEVICE

[75] Inventor: Reinhold Euler, Kelkheim, Fed. Rep. of Germany

[73] Assignee: Hoechst Aktiengesellschaft, Frankfurt am Main, Fed. Rep. of Germany

[21] Appl. No.: 589,006

[22] Filed: Mar. 13, 1984

[30] Foreign Application Priority Data

Mar. 16, 1983 [DE] Fed. Rep. of Germany ..... 3309398

[51] Int. Cl.[4] ..... G03G 15/20

[52] U.S. Cl. ..... 355/3 FU; 355/14 FU; 219/216; 219/470

[58] Field of Search ..... 355/3 FU, 14 FU; 219/216, 388, 469, 470, 471; 432/60

[56] References Cited

U.S. PATENT DOCUMENTS

| | | | |
|---|---|---|---|
| 3,498,596 | 3/1970 | Moser | 263/6 |
| 3,505,497 | 4/1970 | Lawes et al. | 219/216 |
| 3,539,161 | 11/1970 | Byrne | 263/6 |
| 3,832,524 | 8/1974 | Takiguchi | 219/216 |
| 4,001,545 | 1/1977 | Wada et al. | 219/216 |
| 4,075,455 | 2/1978 | Kitamura et al. | 219/216 |
| 4,232,959 | 11/1980 | Ateya et al. | 355/3 |
| 4,297,562 | 10/1981 | Kamogawa et al. | 219/216 |
| 4,301,359 | 11/1981 | Ito et al. | 355/3 FU X |
| 4,480,908 | 11/1984 | Anzai et al. | 355/14 FU |

FOREIGN PATENT DOCUMENTS

| | | | |
|---|---|---|---|
| 0017092 | 10/1980 | European Pat. Off. . | |
| 3224239 | 1/1983 | Fed. Rep. of Germany . | |
| 1492748 | 7/1967 | France . | |
| 0119160 | 9/1981 | Japan | 355/3 FU |
| 0053773 | 3/1982 | Japan | 355/3 FU |
| 0063570 | 4/1982 | Japan | 355/14 FU |
| 0158866 | 9/1982 | Japan | 355/14 FU |
| 0211180 | 12/1982 | Japan | 355/14 FU |

*Primary Examiner*—Arthur T. Grimley
*Assistant Examiner*—J. Pendegrass
*Attorney, Agent, or Firm*—Schwartz, Jeffery, Schwaab, Mack, Blumenthal & Evans

[57] ABSTRACT

A fixing roller device having a pressure roller and a heating roller as the fixing roller. Heating elements sealed into glass cylinders are located inside the heating roller, parallel to a roller axis. One heating element consists of a coil in a middle zone of the heating roller, while the other heating element has two coils in edge zones of the heating roll. Two temperature sensors are arranged respectively in the middle of the heating roller and near one of the end faces of the heating roller, at a small distance from the heating roller surface, and are connected to a control system which controls the current supply to the heating elements and cuts this supply as soon as the temperatures measured by the temperature sensors reach predetermined intended values.

15 Claims, 4 Drawing Figures

FIXING ROLLER DEVICE

BACKGROUND OF THE INVENTION

1. Field of the Invention

The invention relates to fixing roller devices for photocopiers comprising a pressure roller and an internally heated heating roller as the fixing roller for fixing a toner image on copying material.

2. Background Art

A fixing roller device is the component of a photocopier which fixes toner, usually a particulate plastic material, which has been electrostatically deposited upon a copy medium, most often paper. Such a fixing roller device has two cylindrical rollers in lengthwise contact. One roller is internally heated, and is called the heating roller. The other presses against the heating roller and is called the pressure roller. The paper bearing the unfixed toner passes between the rollers, and the combination of heat and pressure causes the toner to fuse and adhere to the paper. The surface temperature of the heating roller is ideally neither so low that fixing is incomplete and the toner easily wiped off, nor so high that toner is transferred from the paper to the roller, producing a so-called offset effect, in which part of the toner image is subsequently transferred onto other areas of the copying paper.

It was believed in the past that the surface temperature distribution along the axial (lengthwise) direction should ideally be as uniform as possible. Nevertheless, a typical prior art fixing roller device includes a heating roller having an electrical heating element arranged in its interior, parallel to the roller axis. This causes the surface of the heating roller to have an uneven surface temperature distribution in the axial direction. A temperature sensor is typically located opposite the surface of the heating roller and is connected to a control system which supplies current to the heating element.

A heating fixing roller device of this type is shown in German Pat. No. 2,949,996. In this device, the heating element is an infrared radiator which exhibits a higher radiation density at its ends than in its middle. When it is switched on, the uneven radiation density results in an uneven surface temperature distribution in the axial direction of the fixing roller having a minimum in the middle and at each of the two axial ends, and a maximum between each end minimum and the middle minimum. The sole temperature sensor is located near the surface of the fixing roller which is at the maximum temperature.

As stated above, in this fixing roller device there is no temperature distribution maximum in the middle; instead the maxima occur between the two ends and the middle of the fixing roller. Even with such an arrangement an undesirable overshooting of the intended temperature values will occur at the temperature distribution maxima. This effect is compensated, however, by the presence of the zones of lower temperature in the middle and at the two ends of the heating roller, and any tendency of the temperature distribution to even out and reach a uniform equilibrium temperature. The overshooting of the temperatures results from the fact that while the temperature sensor, upon detecting the preset desired temperature, switches off the current supply to the heating element, the fixing roller has by that time already stored a substantial amount of heat and the "thermal inertia" of the system produces temperatures above the preset value.

German Offenlegungsschrift No. 3,224,239 discloses a roller arrangement for thermal fixing, comprising a heating roller and a pressure roller, between which moves paper carrying a toner image. The heating roller contains a heating element by means of which the surface temperature of the heating roller is kept at a predetermined value. On switching on the copying apparatus, the heating roller and the pressure roller rotate before the surface temperature of the heating roller has reached the predetermined temperature. As soon as this temperature has been reached the motor which causes the heating roller and the pressure roller to rotate is switched off. The heating element in the heating roller is controlled by means of a temperature sensor, which is located at a position to measure the surface temperature of the heating roller.

U.S. Pat. No. 4,323,959 discloses a toner image fixing apparatus comprising a heating roller and a pressure roller, in which a temperature sensor measures the surface temperature of the heating roller. The magnitude of the force with which the pressure roller presses against the heating roller is regulated according to the measured surface temperature. This is supposed to achieve uniform quality of the toner image on a sheet transported between the two rollers by controlling two parameters which most influence the fixing process, the temperature and the contact pressure. If, for example, the surface temperature increases, the contact pressure is reduced, or the surface temperature is descreased while the contact pressure increases. The interrelation between these two parameters is regulated in accordance with a predetermined surface temperature/contact pressure relation.

The roller fixing station disclosed in European patent application No. 0,017,092 is equipped with a pair of rollers, one of which has outward-tapering end portions. The roller has an outer sleeve which is centrally mounted on an axle. The main parts of the inner surface of the sleeve have stepped portions with increasing diameter at each tapering end of the sleeve. In the tapering end portions of the sleeve, screwable plugs are fixed to parts of the axle. The main body of each plug has a smaller diameter than the surface portion of the inner sleeve. The plugs are rotatable on the axle and move linearly from a retracted position, in which there is clearance between the plugs and the sleeve of the roller, into an engagement position, in which the end flanges of the plugs are in engagement with the stepped portions of the sleeve. In the retracted position the end portions of the sleeve are not supported mechanically by the flanges of the plugs so that the pressure of the counter-roller presses the tapering end portions of the sleeve against the plugs. The degree of taper and the magnitude of the gaps between the plugs and the sleeve are matched to one another so that the behavior of the roller corresponds to that of an essentially even, i.e., non-tapering, roller.

The tapering construction of the roller is retained if the end plugs are screwed inwardly, in the axial direction, and this prevents creasing of the copying paper which usually occurs in the fixing station if the moisture content is high.

If the end plugs are screwed outwardly, in the axial direction, the roller operates like an essentially even cylindrical roller which does not have a taper. Because of the contact pressure of the counter-roller the tapering configuration of the roller is flattened off. The use of this roller under these conditions prevents the so-called smudging effect of a copy under dry conditions, i.e., at very low atmospheric humidity in the fixing station. The plugs can be adjusted manually when the two rollers are separated from one another or can be adjusted by means of a motor which is controlled by a humidity sensor.

The taper achieves a higher cicumferential speed near the edge of the roller so that a sheet of paper passing through the gap between the rollers is subjected to a peripheral speed along its edges which is higher than the speed in the middle. The result of this is that the copying paper stretches and does not crease even at high relative humidity in the fixing station.

Under very dry conditions the copying paper tends to crinkle or form small corrugations so that when the copying paper enters the fixing device it contacts the fixing roller too early, causing smudging of the image.

Thus, in known fixing devices, a very uniform temperature distribution over the length of the fixing roller, with compensation for the temperature drop near the roller ends, is sought in order to maintain constant copy quality. Alternatively, the contact pressure between the fixing roller and the pressure roller is regulated as a predetermined function of the measured temperature. It is also known to use a roller which tapers outwardly in the end portions which flattens under the contact pressure of an adjacent roller, thereby giving uniform contact pressure over the length of the roller and thus avoid creasing.

SUMMARY OF THE INVENTION

It is therefore an object of the present invention to provide a fixing roller device so that with both conventional-sized copies such as DIN-A4 (210 mm×297 mm) and DIN-A3 (297 mm×420 mm) and with large-sized copies such as DIN-A2 (420 mm×594 mm) and DIN-A1 (594 mm×841 mm), creasing, corrugation, squeeze creases, and other adverse effects are prevented and a variety of copying materials such as opaque or transparent papers or films can be used.

This object is achieved by the present invention by providing a heating roller having a first end zone, a middle zone and a second end zone along its length. Temperature sensing means sense the surface temperatures of the middle zone and at least one end zone, and a control system connected to the temperature sensing means controls means for varying the first and second end zone surface temperatures with respect to the middle zone surface temperature.

The invention achieves the advantages that large copies can be produced free of creases and corrugation regardless of the nature of the copying material and that the surface profile of the fixing roller at the instant of contact with the pressure roller is determined by the temperature profile, which can be controlled over the length of the fixing roller. Surface profile control is thus achieved at low expense, compared to the conical contruction of the known fixing roller having screwable plugs which are adjustable in the axial direction of the roller.

Further objects, features and advantages of the present invention will become apparent from the detailed description of preferred embodiments which follows, when considered together with the attached figures of drawing.

BRIEF DESCRIPTION OF THE DRAWINGS

The invention is explained in more detail below with reference to an illustrative embodiment depicted in the drawing, in which.

DETAILED DESCRIPTION OF PREFERRED EMBODIMENTS

In the present invention there is disposed within the heating roller a second electrical heating element, which is connected to the control system through an additional temperature sensor. This second element runs parallel to the roller axis. The first heating element has a middle coil in the middle zone of the heating roller and the second or other heating element has two end coils disposed near the edge zones of the heating roller adjacent the left and right of the middle zone. The middle coil in the middle zone overlaps with each end coil in each edge zone, and the current supply to the heating elements is controlled so that on the surface of the heating roller there results a surface temperature distribution in the axial direction which exhibits a local minimum or maximum in the middle zone and maxima near the two end faces of the roller, one of the two temperature sensors is located near the extremum of the surface temperature in the middle of the roller, and the other temperature sensor is located near the middle of one of the edge zones of the heating roller.

Figure 1:
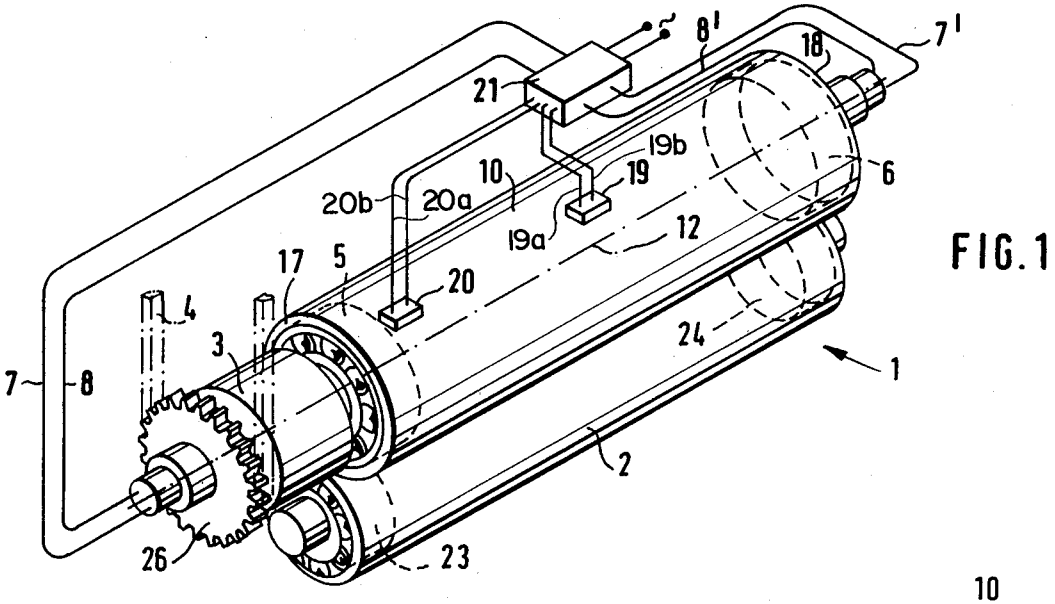
FIG. 1 is a partial, diagrammatic perspective view of a fixing roller device according to the invention.

A fixing roller device 1 depicted in FIG. 1 comprises a heating roller 10 and a pressure roller 2. The upper heating roller 10 or fixing roller is mounted in bearings 5 and 6, for example ball bearings, and the lower pressure roller 2 is mounted in bearings 23 and 24, which are each arranged in the interior of the rollers. In the preferred embodiment, the bearings are mounted within the rollers approximately 20 mm from their respective end faces of the rollers. The upper heating roller 10 has an approximate length of 670 mm and is made of an aluminum tube having a wall thickness of 7 to 9 mm and carrying a silicone rubber coating 25 (FIG. 2) having a thickness of about 1 to 1.2 mm. The silicone rubber coating terminates about 30 to 33 mm short of the end faces 17 and 18 of the heating roller 10. The pressure roller 2 also has an aluminum cylinder, having a wall thickness of about 6 mm and bearing a coating of silicone rubber and a tube of a shrink film, the thickness of the silicone rubber coating and the tube together being about 3 mm. This coating extends from end face to end face of pressure roller 2.

The pressure roller 2 cooperates with the heating roller 10 to grip the copying material and transport it between the two rollers.

The shaft portion which protrudes from the end face 17 of the roller 10 bears a coupling 3 with a gear wheel 26 which is driven by a toothed belt 4 or a roller chain.

Near the surface at the mid-length along heating roller 10 is located a first temperature sensing means 19, which can be, for example, a thermistor or a thermocouple. Two connecting wires 19*a*, 19*b* connect sensing means 19 to a control system 21, indicated diagrammatically in FIG. 1, which controls the copying program sequence. Near the surface and the one end 17 of heating roller 10 is placed a second temperature sensing means 20, which can also be either a thermistor or a thermocouple. Two connecting wires 20*a* and 20*b* connect second temperature sensing means 20 to the control system 21. First and second temperature sensing means 19 and 20 ensure that the current supply to heating elements, which are located in the interior of the heating roller and which will be described later, is cut when predetermined temperatures are reached at the measurement points. Connecting wires 7, 8, 7', and 8' lead from the interior of the heating roller 10 where the heating elements are located to the control system 21 which possesses a control circuit for the actuation of relays which disconnect the heating elements from the current supply when predetermined values of the temperature are reached.

Figure 2:
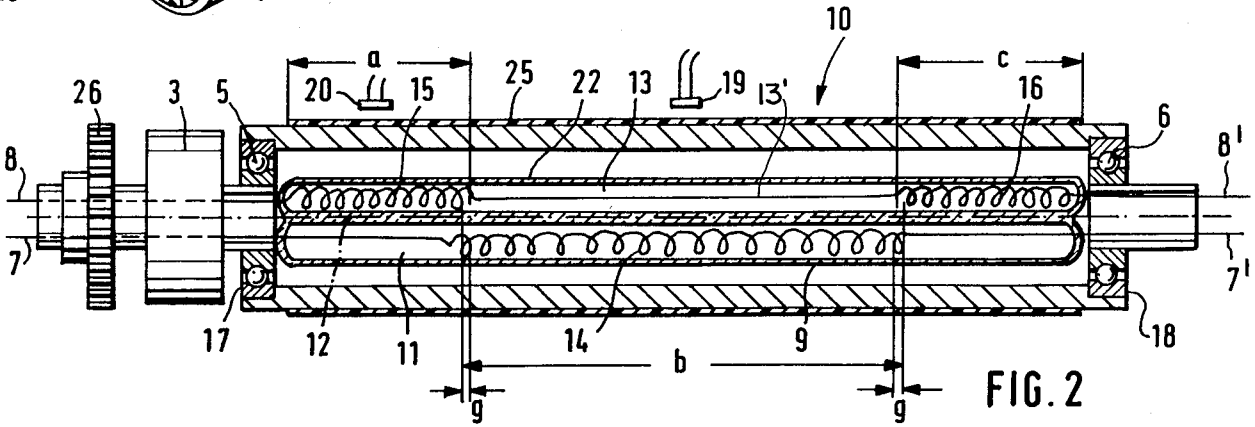
FIG. 2 shows a section through the heating roller of the fixing roller device depicted in FIG. 1.

Additional details of the construction of the heating roller 10 may be seen from FIG. 2. In the interior of the heating roller 10 are disposed two electrical heating elements 11 and 13 which run parallel to roller axis 12. First heating element 11 is enclosed by a glass cylinder 9 in which runs a middle coil 14 which extends over the middle zone b of the heating roller 10. The length of this middle zone b in the preferred embodiment is about 310 mm. Connecting wires 7 and 7' lead out of the glass cylinder 9, each from its respective end of coil 14. A second heating element 13 has two end coils 15 and 16 which are located in the edge zones a and c of the heating roller adjoining the middle zone b on the left and right. The two end coils 15 and 16 are connected in the middle by a heating wire 13' and are sealed in a glass cylinder 22, through each end wall of which passes connecting wire 8 and 8' respectively of the heating element 13. The individual coil 15 or 6, respectively, in the preferred embodiment has a length of about 150 mm. The length of the coil 14 in the middle zone b in the preferred embodiment corresponds at least to the width of a DIN-A3 format sheet and is in general 300 to 305 mm.

Figure 3:
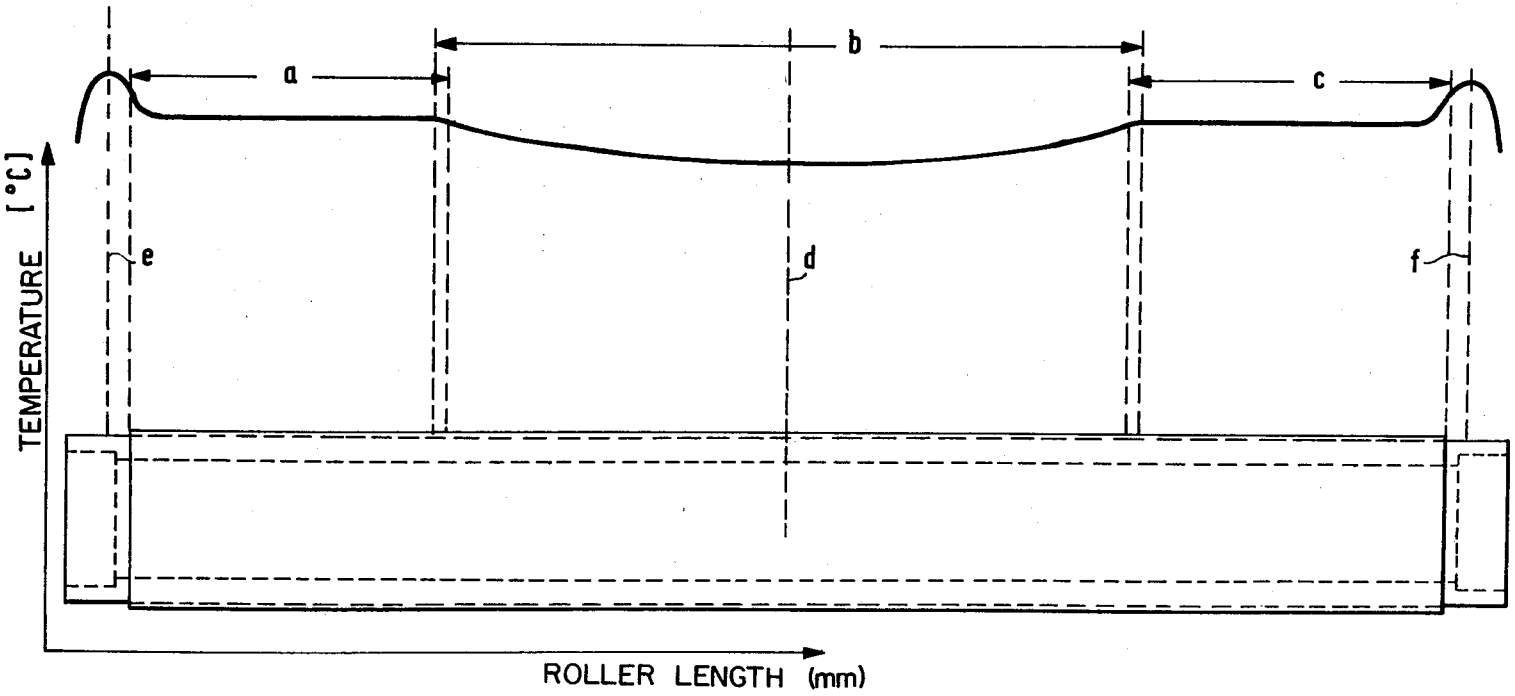
FIG. 3 shows a graphical representation of one possible temperature profile over the length of the fixing roller.

In the preferred embodiment, middle coil 14 in the middle zone b overlaps, in a zone g, with each of the end coils 15 and 16 in each of the edge zones a and c respectively. The preferred amount of this overlap is up to about 5 mm. The current supply to the heating elements 11 and 13 is controlled so that a surface temperature distribution depicted in FIG. 3 results in the axial direction of the heating roller 10. As can be seen from FIG. 3, the temperature distribution has a local minimum d having a first value in the middle zone b. The surface temperature then rises monotonically and symmetrically to assume a relatively constant value in each end zone. The surface temperature distribution exhibits local maxima e and f near the two end faces 17 and 18 of the heating roller 10. For precise control of the temperature distribution, first temperature sensing means 19 is preferably located adjacent to a position about midway along the length of heating roller 10 where the minimum d of the surface temperature distribution occurs, and the second temperature sensing means 20 is preferably located near the surface and one of the local maxima of the surface temperature distribution near one of the end faces 17 or 18. As a result of the overlap of the coils 14, 15, and 16 a substantially uniform temperature profile is achieved at the points of transition from the middle zone to the edge zones.

The heating elements 11 and 13 are preferably controlled by first and second temperature sensing means 19 and 20 respectively in such a manner that a temperature difference $\Delta T$ of 2° to 10° C. between the middle of the heating roller 10 and the edge zones a and c of the heating roller is set up. This temperature difference becomes established as soon as the two heating elements 11 and 13 are heated.

The magnitude of the temperature difference $\Delta T$ is determined according to the type of copying material, a smaller temperature difference generally being chosen for opaque paper than for transparent paper.

In the preferred embodiment, the two heating elements are heated in such a manner that, if DIN-A4 and DIN-A3 copies are initially desired, at first only the heating element 11 with the middle coil 14 in the middle zone b of the heating roller 10 is switched on. As soon as the measured temperature difference $\Delta T$ between the middle zone b and the edge zones a and c is greater than 2°–10° C., the control system 21 automatically switches on the heating element 13 with its end coils 15 and 16. This is intended to prevent the temperature difference becoming greater than 10° C. Otherwise, after prolonged operation of the photocopier for making DIN-A3 and DIN-A4 sizes, an operator would have to wait an unacceptably long time when the equipment is switched over to larger sizes such as DIN-A2 and DIN-A1.

If large copies such as DIN-A1 and DIN-A2 are being made from the start, both heating elements 11 and 13 are switched on simultaneously.

By controlling the surface temperature distribution of the heating roller 10 within the temperature zones, the problems concerning creasing and corrugation which arise, especially with large-sized DIN-A2 and DIN-A1 copies, when using conventional fixing devices with conventional temperature control can be solved. In conventional fixing devices a very uniform temperature over the length of the fixing roller is often set up. This has been found to result in undesirable creasing in the middle of the copy, which in turn results, as precise investigations have shown, from the fact that the speed of passage through the roll gap is greater in the middle than at the edges. This causes the edge zones to converge toward the middle of the copying material. It is this effect which creates the lengthwise corrugation upon passage through the roll gap. Creasing has been observed to occur most often in the middle zones of the second half of a DIN-A1 or DIN-A2 copy on transparent paper.

A further problem with conventional fixing devices in which large-sizes copies are to be made is the duplication of the copy image by a double impression, staggered only a few tenths of a millimeter relative to the first image, in the second half of the DIN-A1 or DIN-A2 copy. This effect is most prevalent with opaque paper. A possible explanation of this phenomenon is that a so-called bow wave forms in the middle of the copying material, resulting in premature contact of the toner image on the bow wave with the heating roll, thus creating a cold offset effect which causes a second image, staggered relative to the first image.

The advantages arising from zonal control of temperature distribution can be understood from the following description of various experiments investigating the dimensional stability of various copying media in the face of variations of ambient temperature and humidity.

In order to establish the causes of creasing and duplication of the original image, so-called narrow web papers were first investigated in a climatically controlled chamber. Narrow web papers are papers which are cut to a predetermined size along the direction of travel of the paper strip. Because of the method of manufacture of these papers, they shrink essentially only in the crosswise direction, but hardly at all in the lengthwise direction, when moisture is removed from them.

The dimensions and nature of the copying materials and the environmental parameters such as temperature, atmospheric humidity, and residence time in the climatically controlled chamber are tabulated below:

| Copying material | Opaque paper | Transparent paper | Hostaphan ® |
|---|---|---|---|
| Length (mm) beginning/end | 500.1/498.7 | 500.8/498.0 | 500.2/500.0 |
| Width (mm) beginning/end | 505.0/499.5 | 514.0/499.0 | 500.3/500.0 |
| Temperature (°C.) beginning/end | 30/20 | 30/20 | 30/20 |
| Atmospheric moisture (%) beginning/end | 93/36 | 93/36 | 93/36 |
| Residence time | 6 h 15 min | 6 h 15 min | 6 h 15 min |
| Length (mm) beginning/end | 500.1/500 | 500.3/500.3 | 500/500.2 |
| Width (mm) beginning/end | 500.2/504.8 | 500.4/513.1 | 500/500.1 |
| Temperature (°C.) | 20/30 | 20/30 | 20/30 |
| Atmospheric moisture (%) beginning/end | 40/85 | 40/85 | 40/85 |
| Residence time | 6 h 45 min | 6 h 45 min | 6 h 45 min |

As the values in the table show, the narrow web papers, whether opaque or transparent, show great dimensional stability in the lengthwise direction, with the maximum shrinkage upon reducing the relative atmospheric moisture by 57% and lowering the temperature from 30° C. to 20° C. being 2.8 mm for a mean length of 500 mm, while in the crosswise direction the maximum shrinkage can be up to 15 mm for a mean width of 500 mm.

On increasing the relative atmospheric moisture the opposite effect occurs, namely an expansion or swelling in the crosswise direction.

It can be seen from the table that transparent paper shrinks more than opaque paper and also expands more on increase of relative atmospheric moisture, whereas a plastic film, for example Hostaphan ®, is substantially dimensionally stable in both the crosswise and lengthwise directions.

If, for example, opaque or transparent paper carrying a toner image to be developed is transported through the fixing station, moisture is extracted from the paper by heat generated by the heating elements, thus causing shrinkage, especially in the crosswise direction. As a result of this, the edge zones of the copying paper converge toward the middle of the copying sheet and thereupon a lengthwise corrugation forms in the middle of the copying paper. Due to build-up occurring in the middle of the roller arrangement, squeezing operation on the rollers results. More material must be transported through the squeezing point that at the edges of the rollers; this is only possible if the speed of passage of the copying paper rises in the middle compared to the edges, but this difference, on the other hand, leads to undesirable creasing, as has been discussed above. To counteract this creasing it is necessary to increase the speed of passage at the edges of the roller arrangement, i.e. to match it to the increased speed of passage, resulting from the paper shrinkage, in the middle of the roller.

It is just such an effect which is achieved through the construction of the heating roller 10 explained above with reference to the drawings. As a result of that zonal regulation of the temperature distribution of the heating roller, the heating roller has a slightly greater diameter in the edge zones, so that the roller pressures in the edge zones and in the middle are matched to one another, and accordingly the speed of passage of the copying paper is approximately constant over the entire width of the roller.

The temperature difference $\Delta T$ between the edge zones and the middle of the roller arrangement should preferably not exceed 10° C., since otherwise the roller pressure in the edge zone becomes greater than in the middle. This causes the speed of passage of the copying paper at the edges to become higher than that in the middle. This then results in double image copying formation, the cause of this being the build-up of the more slowly transported paper zones in the middle leading to formation of the bow wave mentioned above.

Values for the temperature profile over the length of the heating roller 10, described above in connection with FIG. 3 are typically 180° C. in the minimum d, 193° C. in the maxima e and f, and 186° C. over the entire edge zone region. The constant temperature which becomes established in the edge zones is the highest temperature within the heating roller temperature zones which are effective for fixing because the temperature maxima e and f are beyond the silicone coating and accordingly beyond the zone of the roller which contacts the paper.

Figure 4:
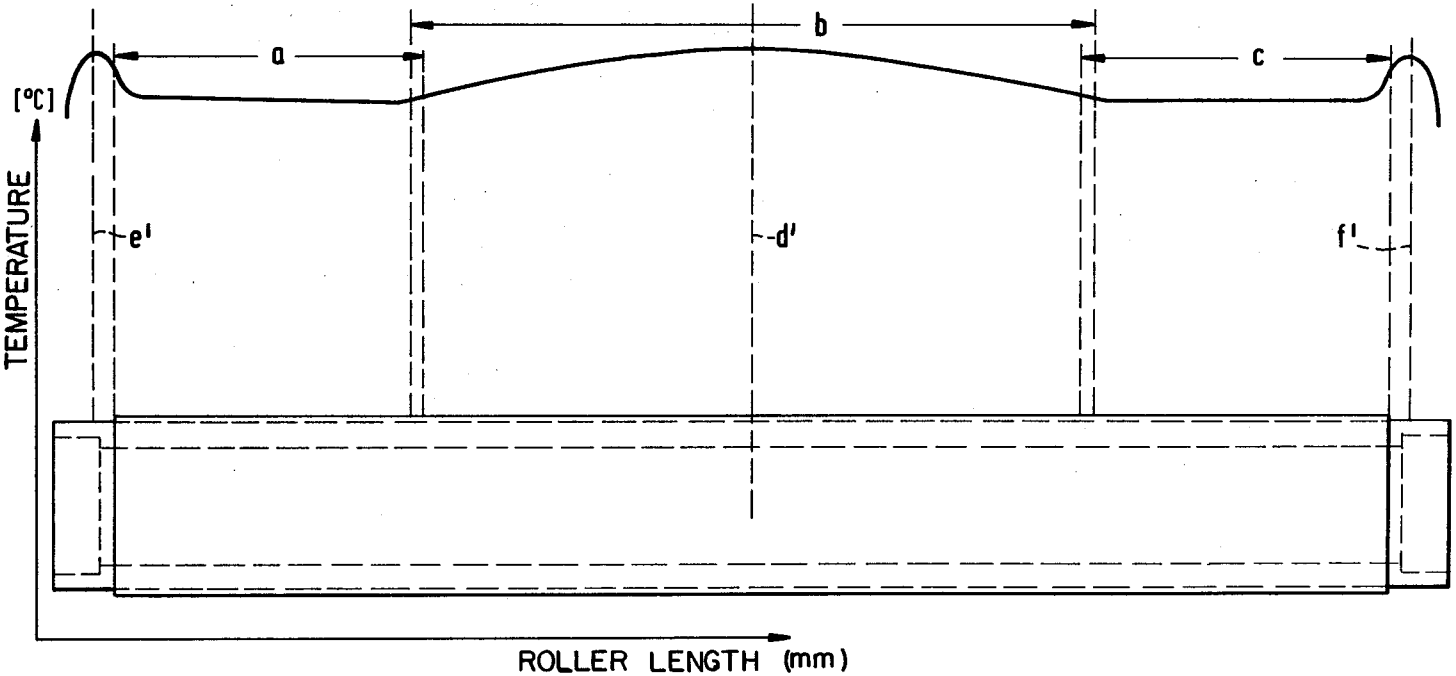
FIG. 4 shows another possible temperature profile over the length of the fixing roller.

FIG. 4 shows an alternative temperature profile over the length of the heating roller, which is desirably maintained after a prolonged period of operation of the fixing station. It is achieved by appropriately controlling the current supply to the heating elements 11 and 13. The advantages of this temperature distribution in such circumstances arise from the fact that the middle zone b of the heating roller is more strongly stressed than the edge zones a and c after a prolonged operation.

The consequence of this is that the diameter in the middle of the heating roller has been found to decrease by about 0.1 mm per 10,000 copies relative to the diameters of the edge zones a and c. Conceivable explanations for this could be greater mechanical abrasion and/or greater expulsion of silicone oil from the silicone rubber coating in the middle of the heating roller. This phenomenon makes preferable a reconfiguration of the temperature profile so that the temperature of the middle zone is increased relative to that of the edge zones. This ensures uniform pressure of the rollers against one another over their entire length.

The characteristic temperatures are, for example, 182° C. in the maximum d' of the middle zone, about 181° C. in the maxima e' and f' and an average of 175° C. in the edge zones, in the case of the temperature profile according to FIG. 4.

Although only one embodiment of the present invention has been described above in detail, it will be appreciated by one of ordinary skill in the art that various departures from the specific embodiment disclosed are possible without departing from the fundamental scope of the invention. Accordingly, the invention is not intended to be and should not be regarded as limited to the specific embodiment described, but is rather limited only according to the following claims.

What is claimed is:

1. A fixing roller device, comprising:

a heating roller having a surface and two ends, said surface having a middle zone, including the axial middle of said surface, and a first and second end zone disposed respectively axially and symmetrically to either side of said middle zone between said middle zone and a respective one of said ends;

first means for sensing temperature of said surface at said axial middle;

second means for sensing temperature of said surface in one of said first and second end zones;

a control system responsively connected to said first and second temperature sensing means; and means responsively connected to said control system and arranged inside said heating roller, for producing at said heating roller surface a surface temperature distribution which exhibits a first value at said axial middle, symmetrically tends toward a second value at either end of said middle zone, and then substantially uniformly maintaIns said second value substantially throughout said first and second end zones;

wherein said first value is a local maximum.

2. A fixing roller device as claimed in claim 1 wherein said second value differs from said first value by a quantity which ranges from about 2° to 10° C.

3. A fixing roller device, comprising:

a heating roller having a surface and two ends, said surface having a middle zone, including the axial middle of said surface, and a first and second end zone disposed respectively axially and symmetrically to either side of said middle zone between said middle zone and a respective one of said ends;

first means for sensing temperature of said surface at said axial middle;

second means for sensing temperature of said surface in one of said first and second end zones;

a control system responsively connected to said first and second temperature sensing means; and means responsively connected to said control system and arranged inside said heating roller, for producing at said heating roller surface a surface temperature distribution which exhibits a first value at said axial middle, symmetrically tends toward a second value at either end of said middle zone, and then substantially uniformly maintains said second value substantially throughout said first and second end zones;

wherein said second value differs from said first value by a quantity which ranges from about 2° to 10° C; and wherein said quantity is selected according to the particular copying materil being used.

4. A fixing roller device as claimed in claim 3 wherein said first value is a local minimum.

5. A fixing roller device as claimed in claim 3 wherein said surface temperature distribution producing means comprises first and second heating elements disposed within said heating roller and responsively connected to said control system.

6. A fixing roller device as claimed in claim 5 wherein said first and second heating elements are disposed substantially parallel to an axis of said heating roller.

7. A fixing roller device as claimed in claim 4 wherein:

said first heating element comprises a middle coil arranged primarily within said middle zone; and said second heating element comprises first and second end coils arranged primarily within said first and second end zones respectively.

8. A fixing roller device as claimed in claim 7 wherein said middle coil overlaps at each end with an adjacent end of each of said end coils.

9. A fixing roller device as claimed in claim 8 wherein said middle coil overlaps at each end with an adjacent end of each of said end coils by up to about 5 mm.

10. A fixing roller device as claimed in claim 7 wherein said middle coil has a length of at least equal to the width of DIN-A3 format paper.

11. A fixing roller device as claimed in claim 7 wherein each of said end coils has a length at least equal to about 150 mm.

12. A fixing roller device as claimed in claim 5 wherein said middle coil is caused to heat if DIN-A4 and DIN-A3 format paper is being copied upon.

13. A fixing roller device as claimed in claim 12 wherein said end coils are also caused to heat if said second temperature sensing means senses a temperature more than 2° C. to 10° C. lower than that sensed by said first temperature sensing means.

14. A fixing roller device as claimed in claim 7 wherein both of said first and second heating elements are supplied current, if a DIN-A2 or DIN-A1 format sheet is being copied upon.

15. A fixing roller device, comprising:

a heating roller having a surface and two ends, said surface having a middle zone, including the axial middle of said surface, and a first and second end zone disposed respectively axially and symmetrically to either side of said middle zone between said middle zone and a respective one of said ends;

first means for sensing temperature of said surface at said axial middle;

second means for sensing temperature of said surface in one of said first and second end zones;

a control system responsively connected to said first and second temperature sensing means; and means responsively connected to said control system and arranged inside said heating roller, for producing at said heating roller surface a surface temperature distribution which exhibits a first value at said axial middle, symmetrically tends toward a second value at either end of said middle zone, and then substantially uniformly maintains said second value substantially throughout said first and second end zones;

wherein said second value differs from said first value by a quantity which ranges from about 2° to 10° C.; and wherein said heating roller has a silicone rubber coating terminating within said end zones about 30–33 mm from either end of said heating roll surface, leaving an uncoated segment to either end of said surface, said surface temperature distribution in said first and second zones having a maximum temperature in each of said uncoated segments.

* * * * *